US008875326B1

(12) United States Patent
Bernath et al.

(10) Patent No.: US 8,875,326 B1
(45) Date of Patent: Nov. 4, 2014

(54) FITTED SHEET

(71) Applicants: Lisa Bernath, Valley Village, CA (US); Grunberger Margalit, North Hollywood, CA (US)

(72) Inventors: Lisa Bernath, Valley Village, CA (US); Grunberger Margalit, North Hollywood, CA (US)

( * ) Notice: Subject to any disclaimer, the term of this patent is extended or adjusted under 35 U.S.C. 154(b) by 0 days.

(21) Appl. No.: 13/902,091

(22) Filed: May 24, 2013

(51) Int. Cl.
*A47G 9/02* (2006.01)

(52) U.S. Cl.
CPC ..... *A47G 9/0246* (2013.01); *Y10S 5/907* (2013.01)
USPC ..... 5/497; 5/907; 5/496

(58) Field of Classification Search
CPC ..... A47G 9/0246
USPC ..... 5/482, 496–499, 907
See application file for complete search history.

(56) References Cited

U.S. PATENT DOCUMENTS

| | | | | |
|---|---|---|---|---|
| 4,768,252 | A * | 9/1988 | Ross | 5/497 |
| 4,802,250 | A * | 2/1989 | Farr | 5/482 |
| 4,825,489 | A * | 5/1989 | Ross | 5/497 |
| 5,655,236 | A * | 8/1997 | Murray | 5/495 |
| 5,809,593 | A * | 9/1998 | Edwards | 5/497 |
| 5,815,861 | A * | 10/1998 | LaGrange et al. | 5/504.1 |
| 8,438,679 | B2 * | 5/2013 | Wootten, Jr. | 5/482 |

* cited by examiner

*Primary Examiner* — Michael Trettel
(74) *Attorney, Agent, or Firm* — Buchalter Nemer; Sandra P. Thompson

(57) ABSTRACT

A sheet that includes an upper portion, a lower portion, four side portions and at least one strap is disclosed. The four side portions correspond to a first pair of sides and a second pair of sides. The first pair of sides corresponds to a top side and a bottom side opposite of each other. The second pair of sides corresponds to a left side and a right side opposite of each other. The upper portion is opposite the lower portion. The lower portion has an opening. At least one strap is attached to a point in the lower portion and an opposite point in the lower portion and extends across the opening in lower portion. At least one strap has a single indicator. The indicator indicates the position and/or size of the sheet.

18 Claims, 3 Drawing Sheets

FIG. 2
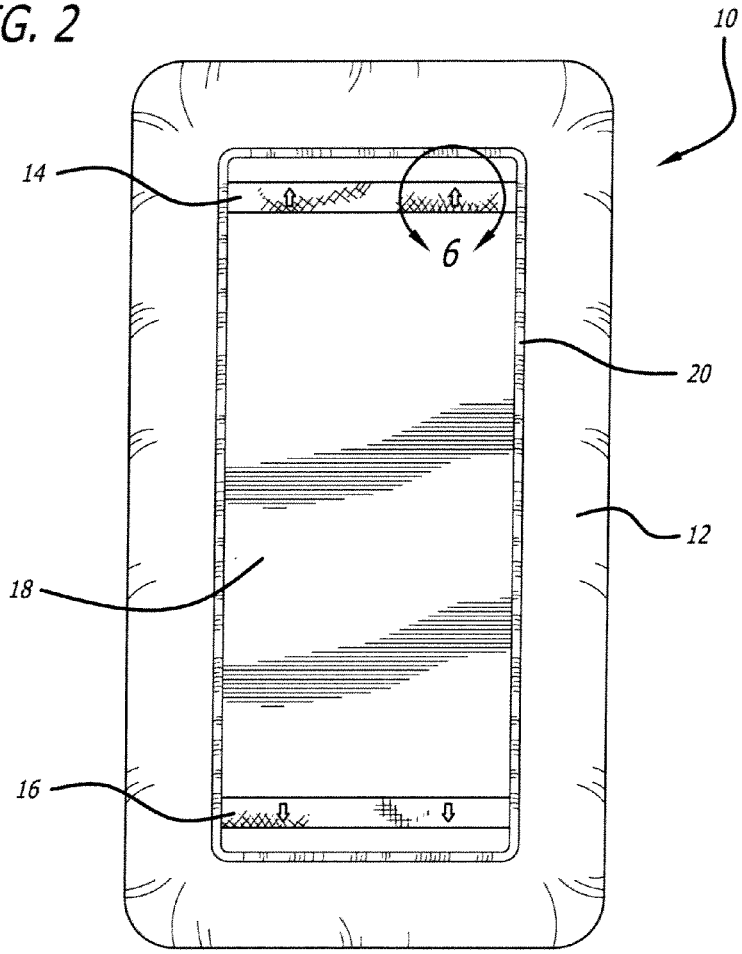
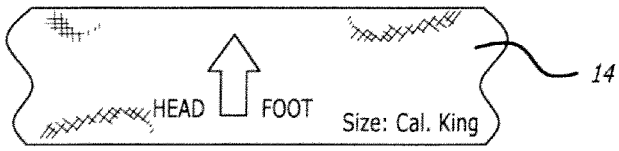
FIG. 6

FITTED SHEET

FIELD OF THE SUBJECT MATTER

The field of the subject matter relates to sheets, in particular, a fitted bed sheet that secures the sheet to the bed and also advises the user which direction the sheet should be placed.

BACKGROUND

Bed sheets are designed for a number of purposes—protection of beds, comfort and decorative purposes. There are a variety of different sheets, from flat to fitted sheets.

A fitted sheet means that the sheet is tailored to be secured or "fitted" to the specific bed size. The "fitted" portion has a top portion and four side portions. The lower portion is directly in contact with the mattress or mattress cover and it not generally exposed to the user. Along the four side portions, opposite the top portion is a bottom edge that is designed to fit under the mattress to further secure the fitted sheet to the mattress. Often times, fitted sheets have an elastic component that runs along or at portions of the bottom edge. In other instances an elastic component is the bottom edge of the fitted sheet. Increasingly, those elastic components are not enough to hold the sheet in place. The sheet curls or comes up on the bed and portions of the bed remain exposed.

Sheets also come in different sizes to be used on different size beds. When sheets are stored with other sheets, it is difficult to determine what size sheet is which. Sheets also come in different patterns in order to match one's aesthetic preferences. When placing sheets on a bed, it may be difficult to properly place them in the appropriate corner or heading.

Therefore, it would be ideal to provide a way of holding the sheet in place and allow the user to easily identify the location the sheet is to be placed and/or the size of the sheet.

SUMMARY OF THE SUBJECT MATTER

A sheet that includes an upper portion, a lower portion, four side portions and at least a single strap is disclosed. The four side portions correspond to a first pair of sides and a second pair of sides. The first pair of sides corresponds to a top side and a bottom side opposite of each other. The second pair of sides corresponds to a left side and a right side opposite of each other. The upper portion is opposite the lower portion. The lower portion has an opening. At least a single strap is attached to the lower portion and extends across the lower portion at points that are on the right side and left side. The at least single strap includes at least a single indicator that indicates the position and/or size of the sheet.

A sheet that includes an upper portion, a lower portion, four side portions, a first strap and a second strap is disclosed. The four side portions correspond to a first pair of sides and a second pair of sides. The first pair of sides corresponds to a top side and a bottom side opposite of each other. The second pair of sides corresponds to a left side and a right side opposite of each other. The upper portion is opposite the lower portion. The lower portion has an opening. The first strap is attached to the lower portion at a point adjacent to the left side and a point adjacent to the right side. The first strap extends across the opening in the lower portion from the point adjacent to the left side to a point adjacent to the right side. The first strap is closest to the top side. The second strap is attached to the lower portion at a point adjacent to the left side and a point adjacent to the right side. The second strap extends across the opening in the lower portion from the point adjacent to the left side to a point adjacent to the right side. The second strap is closest to the bottom side. At least one of the two straps includes at least a single indicator that indicates the position and/or size of the sheet.

BRIEF DESCRIPTION OF THE FIGURES

By way of example only, selected embodiments and aspects of a contemplated embodiment are described below. Each such description refers to a particular figure ("FIG.") which shows the described matter. Each such figure includes one or more reference numbers that identify one or more part(s) or element(s) of the contemplated embodiment.

FIG. 2 shows a bottom view contemplated embodiment of a to sheet.

FIG. 6 shows a contemplated embodiment of a strap of a sheet.

DETAILED DESCRIPTION

Contemplated embodiments, as disclosed herein, provide a way of holding the sheet in place and allow the user to easily identify the location the sheet is to be placed. Specifically, a contemplated sheet includes an upper portion, a lower portion, four side portions and at least a single strap, wherein the four side portions correspond to a first pair of sides and a second pair of sides; wherein the first pair of sides corresponds to a top side and a bottom side opposite of each other; wherein the second pair of sides corresponds to a left side and a right side opposite of each other; wherein the upper portion is opposite the lower portion; to wherein the lower portion has an opening; wherein the least a single strap is attached to two points in the lower portion that are adjacent to a pair of sides. The at least single strap extends across the opening in the lower portion from one side to another.

Figure 1:
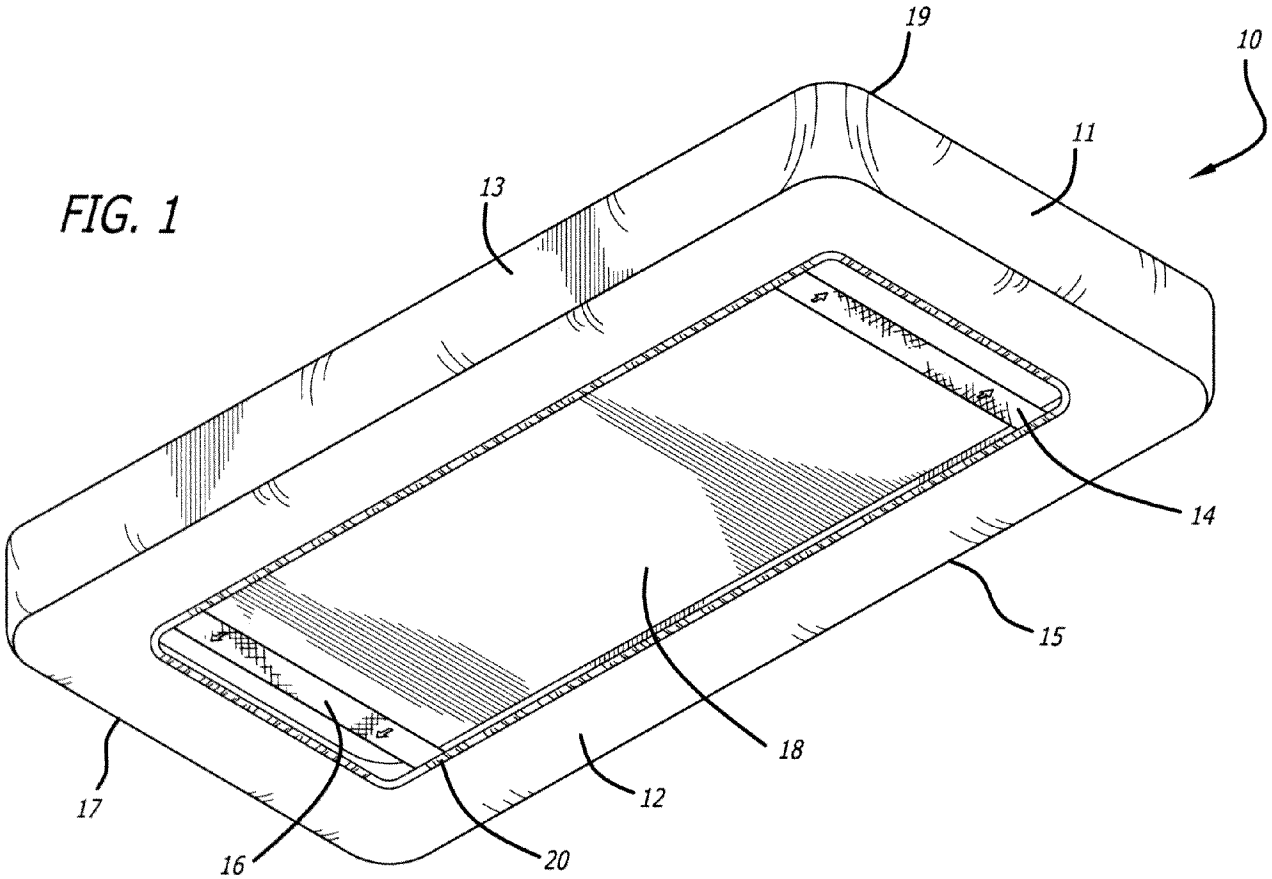
FIG. 1 shows a perspective view of a contemplated embodiment of a sheet.

FIG. 1 shows a contemplated embodiment of the sheet 10. In is this embodiment, the sheet comprises an upper portion 19 (not shown in this figure) and four side portions—a top side 11, bottom side 17 (not shown in this figure), left side 13 and right side 15 (not shown in this figure). The top side 11 is opposite from the bottom side 17. The left side 13 is opposite the right side 15. The sheet 10 also has a lower portion 12 opposite from the upper portion 19. The upper portion 19 is what is laid on top of a bed (not shown) and the four side portions are connected to the upper portion 19. The four side portions are connected to the lower portion 12. The lower portion 12 extends to a portion of the center of the sheet from the four side portions. The lower portion 12 has an opening 18 that allows the sheet 10 to be placed over a bed. In a contemplated embodiment, the upper portion 19, side portions and lower portion 12 are one unitary construction. However, they may be attached individually to each other.

A securing strip 20 runs along the sides of the opening of the lower portion 12, in one contemplated embodiment. Contemplated securing strips 20 may be a piece of elastic material or another suitable stretchable fabric.

In a contemplated embodiment, a first strap 14 is attached to the lower portion 12 at a location on the left side 13 and at a location on the right side 14. The first strap 14 extends across the left side 13 to the right side 14 across the opening 18 of the lower portion 12 at a location closest to the top side 11. In a contemplated embodiment, the first strap 14 is attached to the lower portion 12 by being sewn to the lower portion 12, it may also be attached by an adhesive or other suitable attachment. In a contemplated embodiment, the first strap 14 may be a piece of elastic material or fabric or other suitable stretchable fabric. In a contemplated embodiment, the strap may be either secured in a method that is either removable or detachable such as hook and loop connectors, buttons, or snaps so that the sheet may be placed easily over a bed.

In a contemplated embodiment, a second strap 16 is attached to the lower portion 12 at a location on the left side 13 and at a location on the right side 14. The second strap 16 extends across the left side 13 to the right side 14 across the opening 18 of the lower portion 12 at a location closest to the bottom side 17. In a contemplated embodiment, the second strap 16 is attached to the lower portion 12 by being sewn to the lower portion 12, it may also be attached by an adhesive or other suitable attachment. In a contemplated embodiment, the second strap 16 may be a piece of elastic material or fabric or other suitable stretchable fabric. In a contemplated embodiment, the strap may be either secured in a method that is either removable or detachable such as hook and loop connectors, buttons, or snaps so that the sheet may be placed easily over a bed.

FIG. 2 shows an embodiment of the sheet 10 from the lower portion 12. The lower portion 12 has an opening 18. The lower portion has a securing strip 20 that runs along its edge. The securing strip 20 may be a unitary strip or a plurality of strips placed at different locations throughout the edge of the lower portion 12. The first strap 14 is attached to two points on the lower portion 12 and extends across the opening 18 of the lower portion 12. The second strap 16 is attached to two points of the lower portion 12 and extends across the opening 18 of the lower portion 12.

Figure 3:
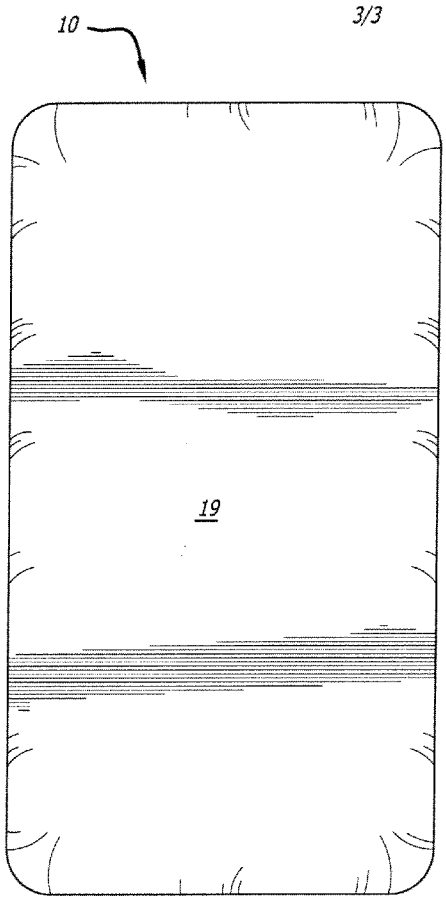
FIG. 3 shows a contemplated embodiment of a sheet.

FIG. 3 shows an embodiment of the upper portion 19 of the sheet 10.

Figure 4:
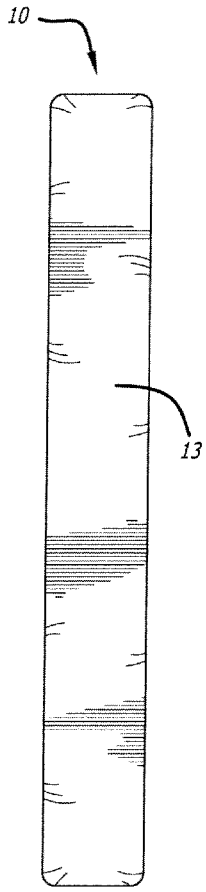
FIG. 4 shows a contemplated embodiment of a sheet.

FIG. 4 shows an embodiment of the left side 13 of the sheet 10.

Figure 5:
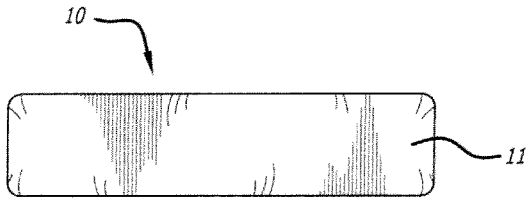
FIG. 5 shows a contemplated embodiment of a sheet.

FIG. 5 shows an embodiment of the top side 11 of the sheet 10.

FIG. 6 shows an embodiment of the first strap 14 as shown in FIG. 2. The strap 14 has at least a single indicator written on it that advises the user is of the position of the sheet and/or the size of the sheet. In alternative embodiments, the indicator may also be fanciful or embellished.

Thus, specific embodiments of sheets have been disclosed. It should be apparent, however, to those skilled in the art that many more modifications besides those already described are possible without departing from the inventive concepts herein. The inventive subject matter, therefore, is not to be restricted except in the spirit of disclosure herein. Moreover, in interpreting the specifications and claims, all terms should be interpreted in the broadest possible manner consistent with the context. In particular, the terms "comprises" and "comprising" should be interpreted as referring to elements, components, or steps in a non-exclusive matter, indicating that the referenced elements, components, or steps may be present, or utilized, or combined with other elements, components, or steps that are not expressly referenced.

What is claimed is:

1. A sheet consisting of an upper portion, a lower portion, four side portions and at least a single strap:

wherein the four side portions correspond to a first pair of sides and a second pair of sides;

wherein the first pair of sides corresponds to a top side and a bottom side opposite of each other;

wherein the second pair of sides corresponds to a left side and a right side opposite of each other;

wherein the upper portion is opposite the lower portion;

wherein the lower portion has an opening and a bottom edge with a securing strip;

wherein the at least single strap is attached to a point on the lower portion and an opposite point on the lower portion; and wherein the at least single strap extends across the opening in the lower portion from the point adjacent to the left side to a point adjacent to the right side.

2. The sheet of claim 1, wherein the point on the lower portion is adjacent to the left side and the opposite point on the lower portion is adjacent to the right side.

3. The sheet of claim 1, wherein the point on the lower portion is adjacent to the top side and the opposite point on the lower portion is adjacent to the bottom side.

4. The sheet of claim 1, wherein there are two straps.

5. The sheet of claim 1, wherein the at least single strap has an indicator.

6. The sheet of claim 5, wherein the indicator is printed.

7. The sheet of claim 6, wherein the indicator indicates the orientation of the sheet.

8. The sheet of claim 6, wherein the indicator indicates the size of the sheet.

9. The sheet of claim 1, wherein the at least single strap comprises elastic material.

10. The sheet of claim 1, wherein the securing strip comprises elastic material.

11. The sheet of claim 1, wherein the lower portion extends inwards towards the center to make the opening smaller than the upper portion.

12. A sheet consisting of an upper portion, a lower portion, four side portions, a first strap and a second strap:

wherein the four side portions correspond to a first pair of sides and a second pair of sides;

wherein the first pair of sides corresponds to a top side and a bottom side opposite of each other;

wherein the second pair of sides corresponds to a left side and a right side opposite of each other;

wherein the upper portion is opposite the lower portion;

wherein the lower portion has an opening and a bottom edge with a securing strip;

wherein the first strap is attached to the lower portion at a point adjacent to the left side and a point adjacent to the right side;

wherein the first strap extends across the opening in the lower portion from the point adjacent to the left side to a point adjacent to the right side; wherein the first strap is closest to the top side;

wherein the second strap is attached to the lower portion at a point adjacent to the left side and a point adjacent to the right side; and wherein the second strap extends across the opening in the lower portion from the point adjacent to the left side to a point adjacent to the right side; wherein the second strap is closest to the bottom side.

13. The sheet of claim 12, wherein the first strap has an indicator.

14. The sheet of claim 13, wherein the indicator indicates the orientation of the sheet.

15. The sheet of claim 13, wherein the indicator indicates the size of the sheet.

16. The sheet of claim 12, wherein the first strap and second strap comprise elastic material.

17. The sheet of claim 12, wherein the lower portion extends inwards towards the center to make the opening smaller than the upper portion.

18. The sheet of claim 13, wherein the indicator is printed.

* * * * *